US005095654A

United States Patent [19]

Eccleston

[11] Patent Number: 5,095,654

[45] Date of Patent: Mar. 17, 1992

[54] AUTOMATIC OPERATING SYSTEM FOR SWINGING DOOR

[76] Inventor: Jon E. Eccleston, 88 Los Cerros Ave., Walnut Creek, Calif. 94598

[21] Appl. No.: 741,054

[22] Filed: Aug. 6, 1991

Related U.S. Application Data

[63] Continuation of Ser. No. 559,639, Jul. 30, 1990, Pat. No. 5,050,346.

[51] Int. Cl.[5] ..... E05F 15/00

[52] U.S. Cl. ..... 49/280; 49/300; 292/33; 292/144

[58] Field of Search ..... 49/280, 300, 302; 292/144 X, 32, 33 X, 39, 41, 38

[56] References Cited

U.S. PATENT DOCUMENTS

| | | | |
|---|---|---|---|
| 898,865 | 9/1908 | Galarneau et al. | 49/300 |
| 1,920,868 | 8/1933 | Kirk | 49/280 X |
| 2,091,388 | 8/1937 | Dorsey | 49/280 |
| 2,538,980 | 1/1951 | Payne, Jr. | 49/300 X |
| 3,099,438 | 7/1963 | Fritz | 49/280 X |
| 3,791,180 | 2/1974 | Doyle | 292/39 X |
| 3,996,591 | 12/1976 | Hayward | 292/144 X |
| 4,913,475 | 4/1990 | Bushnell et al. | 292/144 |

*Primary Examiner*—Philip C. Kannan
*Attorney, Agent, or Firm*—Schapp and Hatch

[57] ABSTRACT

An automatic operating system for swinging doors which is controlled by the user by means of a miniature, hand-held radio transmitter having a single operating pushbutton.

Depression of the pushbutton results, sequentially, in the retraction of the deadbolt, the retraction of the main latch, and the opening of the door. The door then remains open until the pushbutton is again depressed, whereupon the main latch is extended, the door is swung to its closed position, the deadbolt is extended into its associated recess in the doorjamb, and the air pressure in the automatic door operating system is bled to atmospheric level, resetting the system to its normal or quiescent state.

8 Claims, 5 Drawing Sheets

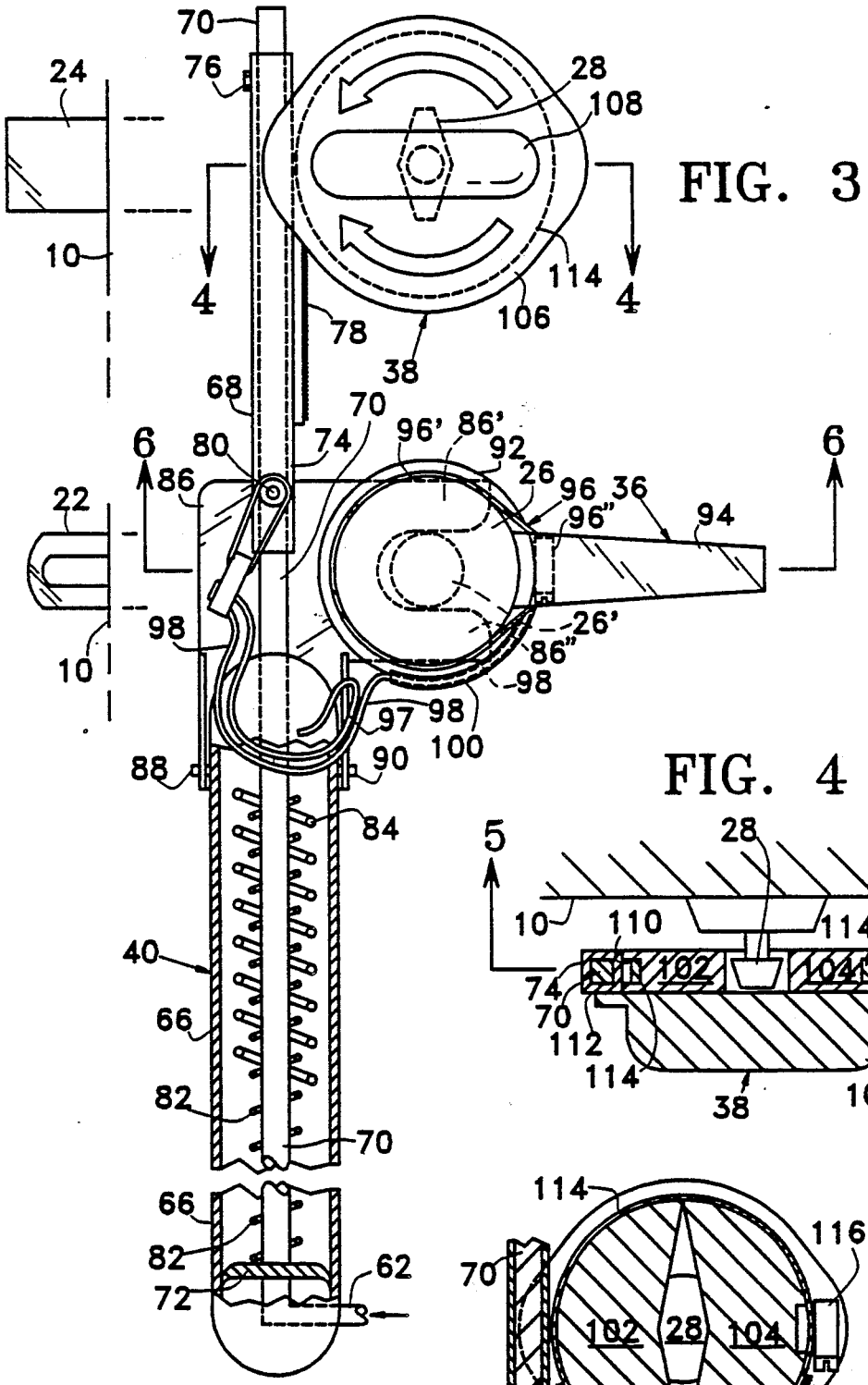
FIG. 3
FIG. 4
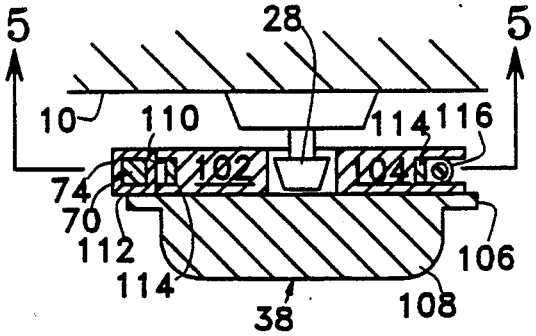
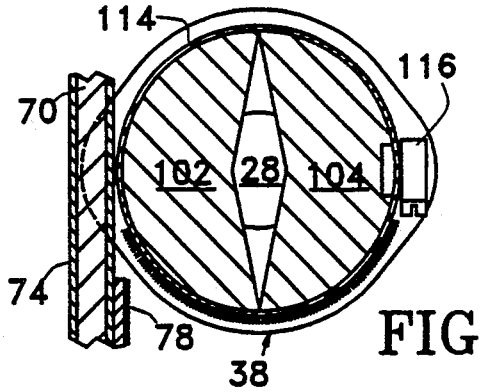
FIG. 5

AUTOMATIC OPERATING SYSTEM FOR SWINGING DOOR

This is a continuation of co-pending application Ser. No. 07/559,639 filed on July 30, 1990, now U.S. Pat. No. 5,050,346.

BACKGROUND OF THE INVENTION

1. Field of the Invention

My invention relates to door operating systems, and more particularly to automatic operating systems for swinging doors.

2. Description of the Prior Art

Automatic operating systems for sliding and swinging (sidehung) doors are well known in the prior art.

Self-contained electromechanical automatic door openers which operate by both manual and automatic actuation on both right hand hung and left hand hung doors are made and sold by Roto/Swing, Inc., of Oklahoma City, Okla. Radio-controlled systems are provided. Copies of catalogue pages from this manufacturer are provided herewith.

Automatic swing door operators are made and sold by Besam, Inc., of East Windsor, N.J. Copies of catalogue pages from this manufacturer are provided herewith.

Automatic door operators are made and sold by Keane Monroe Corporation, Monroe, N.C. Copies of catalogue pages from this manufacturer are provided herewith.

Generally, however, these prior art automatic door openers are characterized by high cost, the need for professional installation, or both; which makes them economically unavailable to many potential users.

Additionally, these prior art automatic door openers in general involve destructive installation, i.e., the necessary modification of doors, door jambs, or parts of the building adjacent the door frame.

Yet further, these prior art automatic door openers must, in general, be incorporated into the door or the door frame, or both; thus qualifying them as "fixtures", which under many state laws requires that they be left in place when the rented or leased premises in which they are installed are vacated.

The term "prior art" as used herein or in any statement made by or on behalf of applicant means only that any document or thing referred to as prior art bears, directly or inferentially, a date which is earlier than the effective filing date hereof.

No representation or admission is made that a prior art search has been made, or that no more pertinent information relating to the prior art than contained herein exists.

SUMMARY OF THE INVENTION

Accordingly, it is an object of my invention to provide automatic operating apparatus for swinging doors which is inexpensive to purchase for the disabled.

Another object of my invention is to provide automatic operating apparatus for swinging doors which is inexpensive to install for the disabled.

Yet another object of my invention is to provide automatic operating apparatus for swinging doors which can be installed without the assistance of a carpenter or electrician.

A further object of my invention is to provide automatic operating apparatus for swinging doors which can be installed without substantial modification of the door or its frame.

A yet further object of my invention is to provide automatic operating apparatus for swinging doors which can be installed without more modification of the door or its frame than the driving of screws thereinto.

An additional object of my invention is to provide automatic operating apparatus for swinging doors which is characterized by one or more of the abovedescribed desirable features and at the same time is capable of being remotely controlled by means of a miniature hand-held radio transmitter.

A still further object of my invention is to provide automatic operating apparatus for swinging doors which can quickly and easily be removed from a door equipped therewith, and thus does not legally qualify as fixtures, which must be left when the owner of the apparatus quits premises in which the apparatus is installed.

Yet another object of my invention is to provide automatic operating apparatus for swinging doors which apparatus does not interfere with the normal manual operation of a door equipped therewith.

An additional object of my invention is to provide automatic operating apparatus for swinging doors which apparatus completely eliminates the need for an automatic strike plate or plates.

Another object of my invention is to provide automatic operating apparatus for swinging doors which apparatus can be operated without leaving a bed or chair in the room to which that door provides access.

Yet another object of my invention is to provide automatic operating apparatus for swinging doors by means of which a door equipped with both a main latch and a deadbolt can be automatically locked, opened, closed and relocked in response to a radio signal from a hand-held radio transmitter, which signal results from the depression of a single pushbutton.

A further object of my invention is to provide automatic operating apparatus for swinging doors which is easily adapted to a wide variety of doors.

A yet further object of my invention is to provide automatic operating apparatus for swinging doors which apparatus is not damaged in the event that the door encounters an obstacle during operation of the apparatus.

A still further object of my invention is to provide automatic operating apparatus for swinging doors which does not present the risk of injury to human body parts which inadvertantly block the operation thereof.

Other objects of my invention will in part be obvious and will in part appear hereinafter.

My invention, accordingly, comprises the apparatus embodying features of construction, combinations of elements, and arrangements of parts, all as exemplified in the following disclosure, and the scope of my invention will be indicated in the appended claims.

In accordance with a principal feature of my invention an automatic operating system for a swinging door comprises doorknob operating means for manual and power operation of the doorknob of said swinging door, which doorknob operating means is attachable to the doorknob of said swinging door without modification thereof.

In accordance with another principal feature of my invention said automatic operating system for a swinging door further comprises power means for operating said doorknob operating means, and said power means and doorknob operating means are entirely external to the structure of said swinging door.

In accordance with another principal feature of my invention said automatic operating system for a swinging door further comprises power means for operating said doorknob operating means, and said doorknob operating means and said power means are entirely external to the structure of said swinging door but for fastening means which fasten said power means to said swinging door.

In accordance with a yet further principal feature of my invention said automatic operating system for a swinging door further comprises door opening and closing means, power supply means for supplying power to said power means and said door opening and closing means, and manual control means for manually controlling said power supply means, said system being entirely external to the structure of said swinging door but for fastening means which fasten said power means and said door opening and closing means to said door.

In accordance with another principal feature of my invention an automatic operating system for a swinging door having a doorknob and a knob-operated deadbolt comprises deadbolt operating means attachable to said deadbolt for manual and power operation thereof without modification thereof, doorknob operating means attachable to said doorknob for manual and power operation thereof without modification thereof, power means for operating said deadbolt operating means and said doorknob operating means, door opening and closing means, power supply means for supplying power to said power means and said door opening and closing means, and manual control means for manually controlling said power supply means, said power means operating said deadbolt operating means and then said doorknob operating means when said manual control means is manually operated.

In accordance with another principal feature of my invention said power supply means is a source of working fluid.

In accordance with yet another principal feature of my invention said power means includes a translatable member faced with hook-and-loop fastening material.

In accordance with yet another principal feature of my invention said manual control means for manually controlling said power supply means includes a miniature, hand-held radio transmitter whereby said power supply means may be actuated to pressurize working fluid without the intervention of wire connections.

In accordance with yet another principal feature of my invention said deadbolt operating means includes a rotary coupling member having a substantially cylindrical outer surface which is faced in whole or in part with hook-and-loop fastening material and is substantially coaxial with said deadbolt knob.

In accordance with an additional principal feature of my invention the surface of said translatory coupling member is provided with a dead zone which opposes said rotary coupling member when said translatory coupling member is at its position of rest, whereby said deadbolt operating means is then uncoupled from said translatory coupling means to permit manual operation of said deadbolt operating means.

In accordance with a further principal feature of my invention said hook-and-loop fastening means are so selected that they shear against each other if said deadbolt knob is already in the retracted position when said translatory coupling member is translated by said power means.

For a fuller understanding of the nature and objects of my invention, reference should be had to the following detailed description, taken in connection with the accompanying drawings.

BRIEF DESCRIPTION OF THE DRAWINGS

FIG. 3 is an elevational view, partly in section and partly in phantom, of the latch operating system of the preferred embodiment of my invention shown in FIG. 1;

FIG. 4 is a sectional view of the deadbolt knob operator shown in FIG. 3, taken on plane 4—4 of FIG. 3;

FIG. 5 is a sectional view of the deadbolt knob operator shown in FIGS. 3 and 4, taken on plane 5—5 of FIG. 4;

DESCRIPTION OF THE PREFERRED EMBODIMENTS

Figure 1:
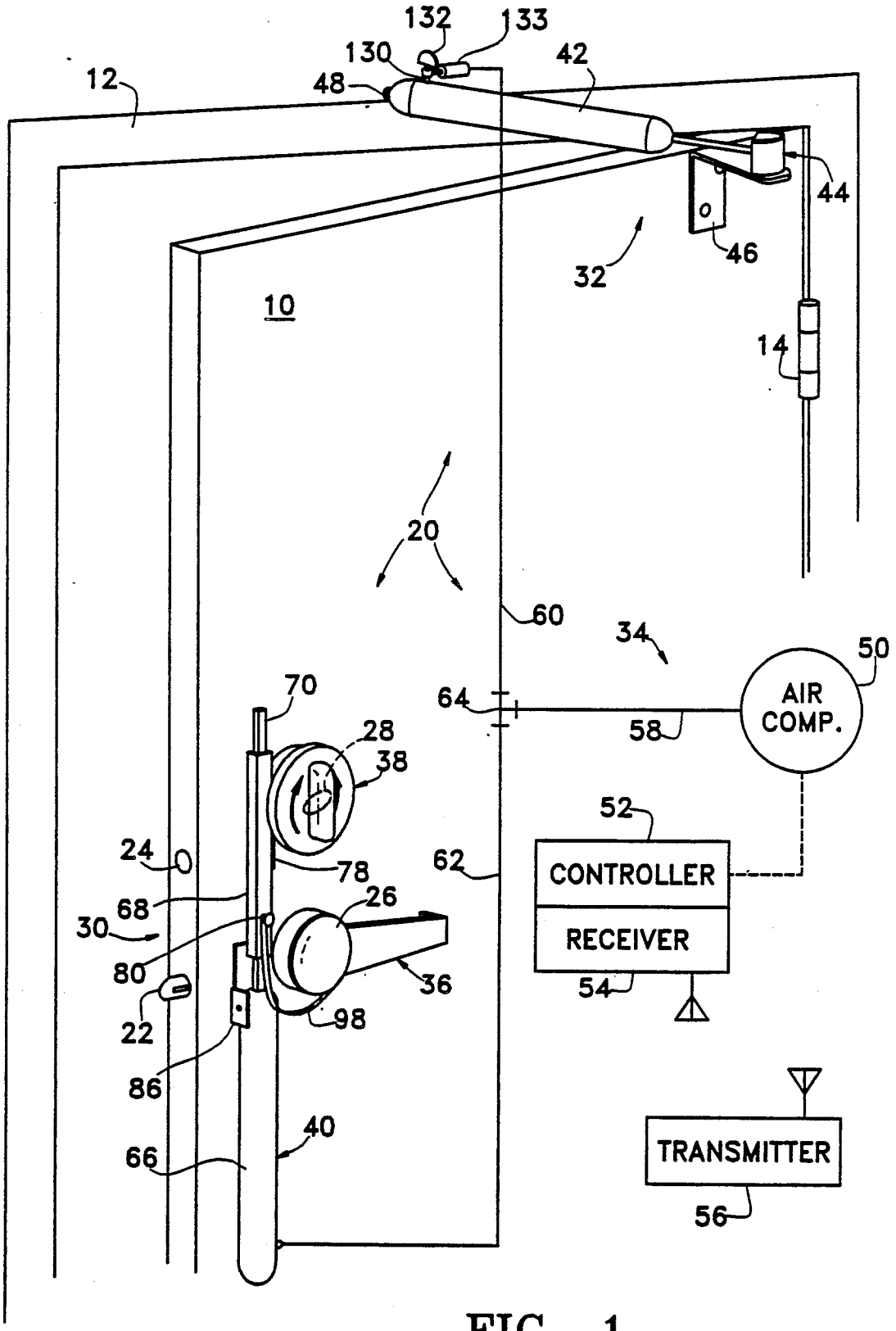
FIG. 1 is a perspective view of an automatic door operating apparatus of my invention, installed upon a swinging door.

Referring now to FIG. 1, there is shown a conventional swinging or side hung door 10 which is hung in a door frame 12 by means of conventional hinges 14, 16 (not shown).

As seen in FIG. 1 door 10 is equipped with an automatic door operating system 20 embodying my invention.

Before the installation of operating system 20 of my invention, door 10 was equipped with a conventional main latch 22 and a conventional deadbolt 24.

In the well known manner, main latch 22 is mechanically coupled to a conventional doorknob 26, and deadbolt 24 is mechanically coupled to a conventional deadbolt knob 28.

Door operating system 20 is comprised of three main subsystems, the knob operating system 30, the door swinging system 32, and the power supply system 34.

Knob operating system 30 is comprised of a doorknob operator 36, which is attachable to doorknob 26 without modification thereof and is adapted for both manual and power operation as hereinafter described.

Knob operating system 30 is further comprised of deadbolt knob operator 38, which is attachable to deadbolt knob 28 without modification thereof and is adapted for manual and power operation in the manner hereinafter described.

Knob operating system 30 is yet further comprised of knob driver assembly 40, which is intermittently coupled to doorknob operator 36 and deadbolt knob operator 38 in the manner hereinafter described.

Door swinging system 32 is comprised of a pneumatic cylinder 42, a torsion spring assembly 44, a door bracket 46, and a doorframe bracket 48.

Power supply system 34 is comprised of an air compressor 50, a controller 52 for controlling the operation of air compressor 50, a radio receiver 54 for actuating controller 52 to selectively energize air compressor 50, and a portable, hand-held radio transmitter 56 for supplying control signals to receiver 54. Transmitter 56 is provided with one pushbutton, successive depressions of which energize and deenergize compressor 50 via receiver 54 and controller 52.

As also seen in FIG. 1, air compressor 50 is connected in compressed air supplying relationship to knob driver assembly 40 and pneumatic cylinder 42 by means of air supply tubes 58, 60, and 62.

As further seen in FIG. 1, air supply tubes 58, 60, 62 are coupled together by means of a Tee coupling 64 of well known type, and thus both knob driver assembly 40 and door swinging system 32 are connected directly, in compressed air supplying relationship, to the output port of air compressor 50.

Referring now to FIG. 3, and comparing the same with FIG. 1, it will be seen that knob driver assembly 40 is principally comprised of a pneumatic cylinder 66 and a piston rod assembly 68. Pneumatic cylinder 66, which will sometimes be called the "knob driver cylinder" herein, is coupled to air supply tube 62, so that any increase in the air pressure at the output port of air compressor 50 is directly transmitted to the interior of knob driver cylinder 66.

As seen in FIG. 3, piston rod assembly 68 is comprised of a piston rod 70 which coacts with the piston 72 in knob driver cylinder 66 in the well known manner. The outer end of piston rod 70 is provided with a close-fitting sleeve 74 which is at all times located outside of cylinder 66, and is clamped to piston rod 70 by means of a suitable clamping fastener 76. The position of sleeve 74 on piston rod 70 is adjustable, and then fixable by means of fastener 76.

A surface area of sleeve 74 is provided with a facing 78 of hook-and-loop fastening material of the kind made and sold under the trademark Velcro. It is to be particularly noted that when the parts of knob operating system 30 are in their respective positions of rest, as shown in FIGS. 1 and 3, facing 78 does not directly confront deadbolt knob operator 38, and thus deadbolt knob operator 38 is free to be manually operated when the respective parts of knob operating system 30 are in their positions of rest.

It is also to be noted in FIG. 3 that sleeve 74 is provided with a projecting finger 80 the purpose of which will hereinafter be described.

As further seen in FIG. 3, knob driver cylinder 66 contains two piston return springs, viz., a full stroke return spring 82 and a partial stroke return spring 84. As will be evident to those having ordinary skill in the art, informed by the present disclosure, the full stroke of piston 72 may be considered to be divided into a low pressure return stroke, during which the movement of piston 72 is effected only by full stroke return spring 82, and a high pressure return stroke, during which the movement of piston 72 is effected by the counterforce of both return spring 82 and return spring 84.

Figure 6:
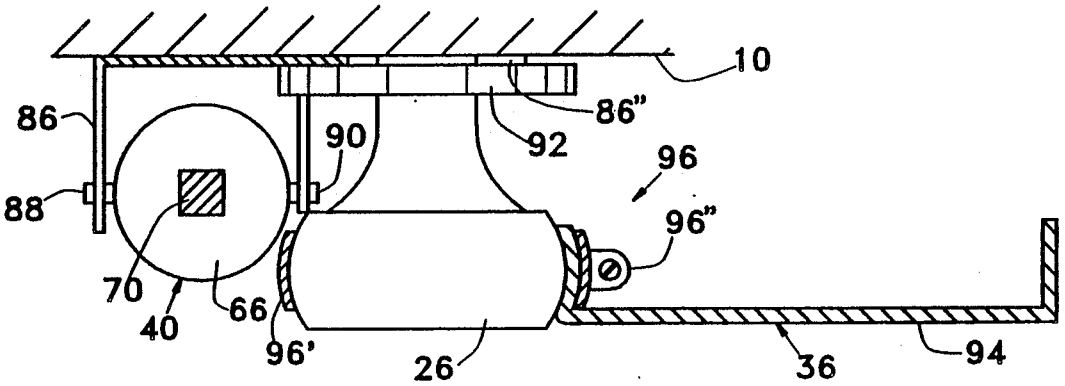
FIG. 6 is a horizontal view, partly in section, of the doorknob operator shown in FIG. 3, taken on plane 6—6 of FIG. 3.

As may be seen by comparison of FIGS. 3 and 6, knob driver assembly 40 is provided with a mounting bracket 86 which is secured to a knob driver cylinder 66 by means of suitable fasteners 88, 90.

As seen in FIG. 3, the main body portion of bracket 86 is provided with two fingers 86', 86" which are adapted to closely embrace the shaft 26' of doorknob 26.

As seen in FIG. 6, the main body portion of bracket 86 is clamped between door 10 and the escutcheon plate 92 of doorknob 26, thus securing knob driver assembly 40 to door 10.

As may further be seen by comparison of FIGS. 3 and 6, doorknob operator 36 is comprised of a handle 94 and a band clamp 96 of well known type which includes a band 96' surrounding doorknob 26 and a band tensioning device 96" of well known type which maintains band 96' in tightly griping engagement with doorknob 26.

Doorknob operator 36 further comprises a coupling strap 98 which couples doorknob operator 36, and thus doorknob 26, to finger 80 of piston rod 70. The inner end of strap 98 is affixed to band 96'. A suitable adjuster 97 is provided so that the length of strap 98 can be adjusted for particular installations. A semi-rigid sleeve 100 surrounds the inner end of strap 98 and prevents strap 98 from slipping over the other face of doorknob 26.

Comparing FIGS. 3, 4 and 5, it will be seen that deadbolt knob operator 38 is adapted to clampingly engage deadbolt knob 28 of door 10.

As best seen in FIG. 5, deadbolt knob operator 38 is comprised of two jaw members 102, 104 the confronting faces of which are configured to clampingly receive deadbolt knob 28.

Deadbolt knob operator 38 is further comprised of a faceplate 106 (FIGS. 3 and 4) upon which is raised a manual operating bar 108.

As seen in FIG. 4, jaw 102 is secured to the rear face of faceplate 106, and jaw 104 is not. The outer edges of jaws 102, 104 are provided with flanges defining respective channels 110, 112, which channels contain a clamping band 114.

A tensioning device 116 of well known type is provided on jaw 104 for maintaining clamping band 114 under tension and thus firmly clamping deadbolt knob 28 between jaws 102 and 104. The outer face of clamping band 114 is covered at least in part with hook-and-loop fastening material capable of coacting with the hook-and-loop fastening material facing 78 of piston rod assembly 68 in the manner of a rack and pinion , whereby each outward and inward stroke of piston rod 70 causes deadbolt knob operator 38, and thus deadbolt knob 28, to be rotated by about 90°.

As seen in FIG. 5, hook-and-loop material facing 78 of piston rod 70 is not engaged with the hook-and-loop fastening material facing of deadbolt knob operator 38 when piston rod 70 is in its downwardmost position, in which piston 72 is fully retracted into knob driver cylinder 66 (FIG. 3). Thus, a "dead zone" is provided whereby deadbolt knob operator 38 may be manually operated when knob driver piston rod 70 is fully retracted as shown in FIG. 3.

Figure 7:
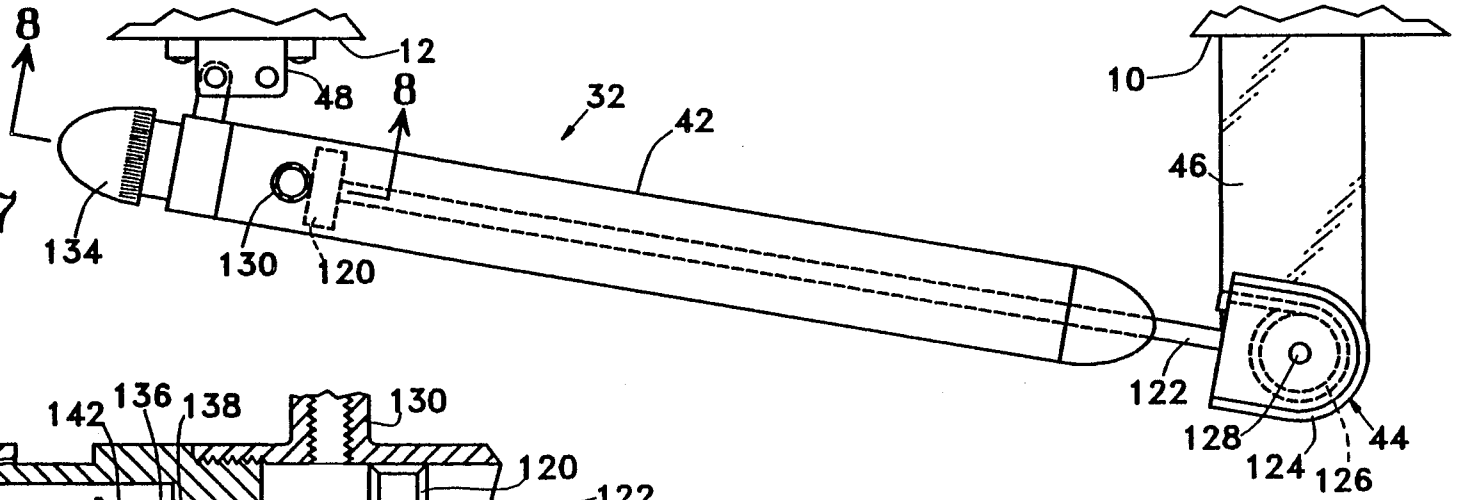
FIG. 7 is a plan view of the door opening and closing means shown in FIG. 1.

Referring now to FIG. 7, it will be seen that pneumatic cylinder 42 of door swinging system 32 contains a piston 120 to which a piston rod 122 is affixed in the well known manner. Piston rod 122 is affixed at its outer end to a housing 124 which contains a torsion spring 126. Housing 124 is pivotably mounted on door bracket 46 which is itself affixed directly to door 10. In the manner well known in pneumatic door checks, torsion spring 126 is affixed at one end to housing 124 and at its other end to pivot pin 128, which is attached to door bracket 46. Thus, the opening of door 10 will result in the cocking of torsion spring 126, and the cocking force stored in torsion spring 126 will cause door 10 to be returned to its closed position as soon as the door displacing force of piston 42 is removed.

As also seen in FIG. 7, the end pneumatic cylinder 42 opposite housing 124 is pivotably affixed to doorframe 12 by means of doorframe bracket 48 (FIG. 1), and pneumatic cylinder 42 is provided with an input pipe 130.

Referring now to FIG. 1, it will be seen that input pipe 130 of pneumatic cylinder 42 is provided with compressed air by means of supply tube 60, through a manual adjustable valve 132.

As also seen in FIG. 1, a flapper type check valve 133 is interposed between supply tube 60 and valve 132, whereby the return of air from cylinder 42 to supply tube 60 is prevented. Thus, in accordance with my invention, the abrupt closing of door 10 by torsion spring 126 (FIG. 7) during manual door operation is prevented, since cylinder 42 damps the return of door 10.

Returning to FIG. 7, it will be seen that a valve adjusting knob 134 is provided at the end of pneumatic cylinder 42 remote from housing 124.

Figure 8:
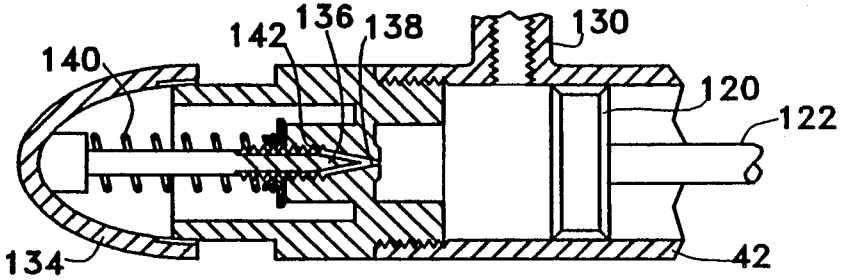
FIG. 8 is a partial horizontal sectional view of the door opening and closing apparatus of FIG. 7, taken on plane 8—8 of FIG. 7.

Referring now to FIG. 8, it will be seen that knob 134 operates a needle valve (144) comprised of valve 136 and valve seat 138 . A coil spring 144 is provided to frictionally engage the threads of valve 136 with the threads 142 where they coact, whereby valve 136 remains in whatever position it is manually set to by means of knob 134, until knob 134 is manually repositioned. Needle valve 144 is so constructed and arranged as to provide an adjustable air bleeding passage between the interior and the exterior of cylinder 42.

OPERATION

Referring now to FIGS. 2A through 2H, the operation of the automatic operating system for swinging doors of the first preferred embodiment of my invention will now be described in detail.

Figure 2A:
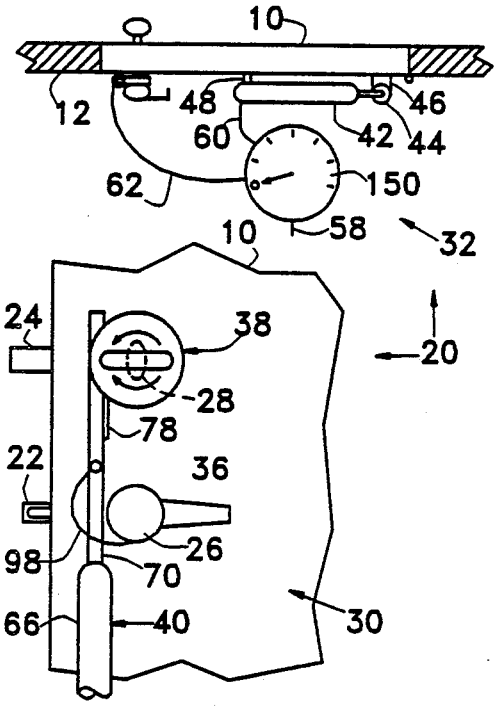
FIGS. 2A through 2H are a sequence of drawings illustrating successive phases of the operating cycle of the automatic swinging door apparatus of FIG. 1.

Going first to FIG. 2A, it will be seen that that figure, like each of the other FIGS. 2B through 2H, includes a highly schematic plan view and a partial view in elevation of door 10, each view including certain parts of the automatic operating system for swinging doors of the first preferred embodiment of my invention as attached to door 10.

It is to be particularly noted that upper (plan) view of FIG. 2A, like the other plan views of FIGS. 2B through FIG. 2H, includes a schematic representation of an air pressure gauge 150.

It is to be understood that such an air pressure gauge is not necessarily included in any operating system for swinging doors constructed in accordance with my invention, but rather is included in FIGS. 2A through 2H in order to graphically illustrate the automatic self-sequencing feature of my invention, whereby the operating steps necessary to correctly unlatch door 10, open door 10, close door 10, and relatch door 10 automatically are carried out in the proper sequence in response to the increasing and decreasing pressure of air in supply tubes 58, 60, 62 produced by air compressor 50 in response to the triggering and retriggering of transmitter 56 by the user.

The lower view of FIG. 2A, and the lower view of each of the other FIGS. 2B through 2H, is a highly schematic representation in elevation of the portion of door 10 adjacent deadbolt knob 28, doorknob 26 and knob driver assembly 40.

It is to be understood that the schematic representation of air gauge 150 in the upper part of FIG. 2A, and in the upper parts of each of the other FIGS. 2B through 2H, does not represent an unusual pressure gauge provided wth an incoming air supply nipple for supply tube 58 and two outgoing air supply nipples for air supply tubes 60, 62. Rather, this representation of air pressure gauge 150 is to be understood to show a standard air pressure gauge having but one port, and that port coupled directly to the common joint of air supply tubes 58, 60, 62. For example, the showing of air pressure gauge 150 in FIGS. 2A through 2H may be taken to represent a standard, one port Bourdon type air pressure gauge the nipple or port of which is directly coupled to a Tee fitting inserted in air supply tube 58 of FIG. 1.

As will now be understood by those having ordinary skill in the art, informed by the present disclosure, each of the FIGS. 2A through 2H schematically represents a door 10, hingedly mounted in a door frame 12, and equipped with the main latch 22 and deadbolt 24 shown in FIG. 1.

It is schematically represented in the lower part of FIG. 2A that door 10 is equipped with the deadbolt knob operator 38, doorknob operator 36, and knob driver assembly 40 shown in FIG. 1.

It is shown in the upper part of each of the FIGS. 2A through 2H that door 10 is equipped with a pneumatic door opening and closing cylinder 42 which is pivotably coupled to door bracket 46 and doorframe bracket 48, all as identified by the corresponding reference numerals in FIG. 1.

Referring now to FIG. 2A, it will be understood by those having ordinary skill in the art, informed by the present disclosure, that this figure represents the normal, quiescent state of door 10 and its associated automatic operating system of my invention. That is to say, FIG. 2A represents the unactuated state of door 10 and automatic operating system 20, prior to the triggering of transmitter 56 (FIG. 1) by the depression by the user of a pushbotton located thereon.

Thus, it will be understood that in FIG. 2A both main latch 22 and deadbolt 24 are engaged in their corresponding recesses in doorframe 12, and that door swinging system 32, including pneumatic cylinder 42, is unpressurized and at rest, and that thus door 10 is fully closed and latched.

It will further be understood by those having ordinary skiill in the art, informed by the present disclosure, that as seen in FIG. 2A deadbolt knob operator 38 is unengaged with hook-and-loop material facing 78 of piston rod 70, and thus is free to be manually rotated for manual operation of deadbolt 24.

It will also be understood from FIG. 2A that in the operating condition shown therein coupling strap 98 is slack, and that thus doorknob operator 36 is free for manual rotation to withdraw main latch 22 from its recess in door frame 12.

Figure 2B:
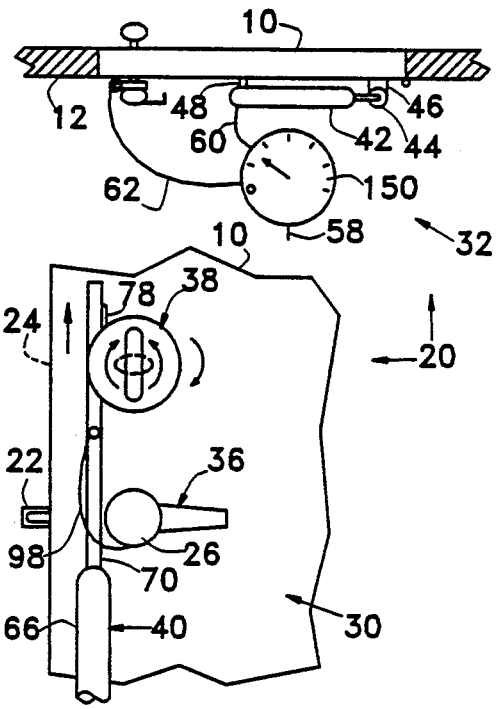

Before referring to FIG. 2B it should be understood that the graduations shown in the schematic representation of pressure gauge 150 are to be thought of as representing increasing air pressure values at five pound intervals. Thus, the graduation adjacent the zero graduation in the schematic representation of pressure gauge 150 is to be considered to be a five pound graduation, and the graduation following that to be a ten pound graduation. Successive graduations shown on the schematic representation of gauge 150 repersent fifteen pound, twenty pound, twenty-five pound, and thirty pound measured pressures, in pounds per square inch gauge.

Referring now to FIG. 2B, it will be seen by those having ordinary skill in the art, informed by the present disclosure, that the user has manually triggered transmitter 56, energizing air compressor 50 and resulting in a rising pressure in air supply tubes 58, 60, 62; which rising air pressure has reached a level between five and ten pounds per square inch gauge. It will also be seen that this increase in air pressure in pneumatic cylinder 66 has resulted in a partial upward stroke of piston rod 70, and that thus deadbolt operator 38 has been rotated by approximately 90°, withdrawing deabolt 24 from its recess in door frame 12.

It will also be seen, however, that coupling strap 98 remains slack, and that thus doorknob operator 36 has not been operated, so that main bolt or latch 22 remains in its recess in doorframe 12.

In an actual operating embodiment of my invention the duration of this phase of operation, i.e., between the condition shown in FIG. 2A and the condition shown in FIG. 2B, was less than one second.

Figure 2C:
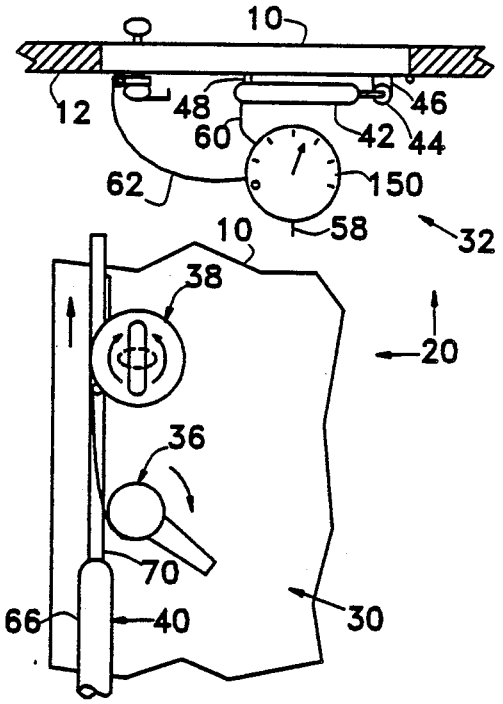

Referring now to FIG. 2C, it will be seen by those having ordinary skill in the art, informed by the present disclosure, that in the second phase of operation of automatic operating system 20 the air pressure supplied by air compressor 50 (FIG. 1) has continued to increase until it has reached a level between fifteen and twenty pounds per square inch gauge.

This increase in air pressure is accompanied by a further outward stroke of piston rod 70 from pneumatic cylinder 66, thus taking upon the slack in coupling strap 98.

As the upward (outward) movement of piston rod 70 continues, the eccentric force exerted by coupling strap 98 rotates doorknob operator 36, and thus rotates doorknob 26, causing main latch 22 to withdraw completely from its associated recess in doorframe 12. This withdrawal of main latch 22 is completed whicn the air supply reaches the level indicated in FIG. 2C, viz., between fifteen and twenty pounds per square inch gauge.

As may be seen from FIG. 3, however, hook-and-loop material facing 78 on piston rod 70 has at this stage of operation bypassed its associated hook-and-loop fastening material facing on deadbolt operator 38, thereby freeing or "escaping" deadbolt knob operator 38 for manual reclosing operation, if deemed necessary. This second dead zone is to create a discreet zone for main latch operation which disengages it from deadbolt operation to prevent premature deadbolt operation during main latch extension at time of door swing closure.

As furher seen in FIG. 2C, which represents the final state of this (second) phase of automatic operating system operation, door 10 remains closed. That is to say, at the end of phase 2, as illustrated in FIG. 2C, both deadbolt 24 and main latch 22 have been withdrawn into door 10, but door 10, remains in its closed position.

It is to be particularly noted that during this second phase of automatic operating system operation piston 72 (FIG. 3) engages the shorter return spring 84 just as coupling strap 98 becomes taut, and thus short return spring 84 is compressed while doorknob 26 is being rotated to withdraw main latch 22 from its associated recess in doorframe 12.

Figure 2D:
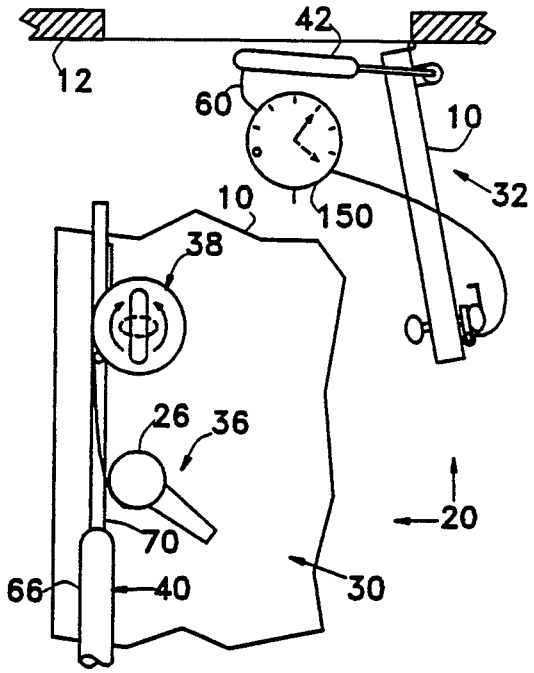

Referring now to FIG. 2D, there is shown the condition of door 10 and automatic operating system 20 at the end of the third phase of the operating cycle of automatic operating system 20.

As may be seen by comparison of FIGS. 2C and 2D, latch operating system 30 remains in the same, fully unlatched condition throughout phase 3 of the operating cycle of automatic operating system 20.

During this third phase, however, door operating system 32, including pneumatic cylinder 42, swings door 10 from its fully closed position (FIG. 2C) to its fully open position (FIG. 2D).

That is to say, air under pressure supplied by way of air supply tubes 58, 60 acting upon piston 120 (FIG. 7) drives piston rod 122 outward, thus forcing door 10 open and cocking return spring 126 (FIG. 7).

As further showing in FIG. 2D, the opening of door 10 to its fully open position takes place while the air pressure in air supply tubes 58, 60, 62 rises from about twenty pounds per square inch guage to over thirty pounds per square inch gauge.

The time duration of this phase is adjustable between about four second and about fifteen seconds. This adjustment is carried out by balancing the rate of air admission to door swinging cylinder 42, by adjusting inflow valve 132 (FIG. 1), over against the rate of leakage of air from door swinging cylinder 42 by means of needle valve 144, by manipulating knob 134 (FIG. 8).

Figure 2E:
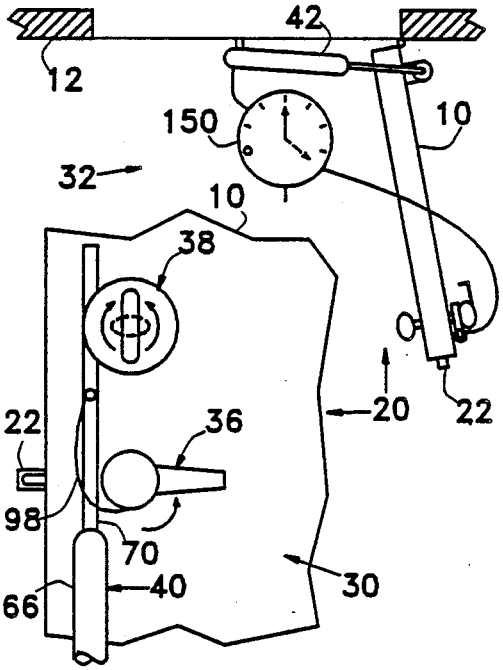

Referring now to FIG. 2E, there is shown the condition of latch operating system 30 and the condition of door swinging system 32 at the end of the fourth phase of the complete operating cycle of automatic operating system 20.

Comparing FIG. 2D and FIG. 2E, it will be seen that the condition of door swinging system 32 remains unchanged. That is to say, door 10 remains fully open.

It will further be seen, however, that during this fourth phase of the operating cycle of automatic operating system 20, piston rod 70 has retreated into piston 66 (downwardly) sufficiently to slacken coupling strap 98 enough to allow doorknob operator 36 and doorknob 26 to return to their normal, unactuated position under the urging of the return spring incorporated in the doorknob assembly which includes doorknob 26. As will be evident to those having ordinary skill in the art, the release of doorknob 26 to return to its normal, unoperated position results in the projection of main latch 22 from the outer edge of door 10.

It should be noted, then, in accordance with the principles of my invention, that main latch 22 is released to project from the outer edge of door 10 before door swinging system 32 begins to close door 10.

It is also to be noted that at the end of the fourth phase of operation of automatic operating system 20, as shown in FIG. 2E, piston rod 70 has retreated downwardly sufficiently far so that spring 84 (FIG. 3) no longer bears upon piston 72.

The decline in system air pressure which results in the retraction of piston rod 70 and the consequent release of doorknob operator 36 and doorknob 26, etc., to their normal, unactuated positions results from the deenergization of air compressor 50, which is brought about by a second depression of the pushbutton on transmitter 56 by the user, the corresponding signal from transmitter 56 then being received by receiver 54 and applied to controller 52 which acts to disconnect air compressor 50 from its electrical power source.

It is to be noted at this point that once compressor 50 of said actual operating embodiment of my invention is deenergized the air pressure in supply tubes 58, 60, 62 drops substantially linearly.

The counterforce produced by the combination of springs 82, 84 (FIG. 3) is sufficiently great so that the complete release of doorknob 26 and the consequent full projection of main latch 22 consumes only about five seconds.

Figure 2F:
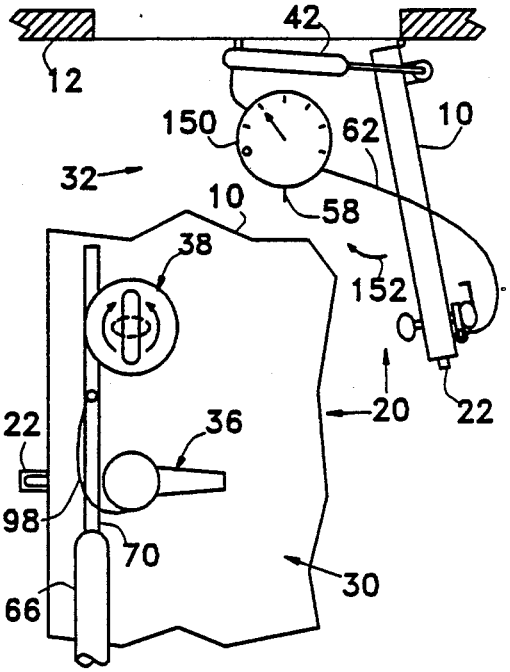

Referring now to FIG. 2F there is shown the fifth phase of the complete operating cycle of automatic operating system 20.

As shown by arrow 152, door 10 is swung from its fully open position to its fully closed position during this fifth phase of the operating cycle of automatic operating system 20.

The energy for thus swinging door 10 to its closed position is derived from torsion spring 126 (FIG. 7) which operates in the manner of the torsion spring found in a conventional door check.

As also seen in FIG. 2F, the system pressure indiciated by pressure gauge 150 drops to approximately ten pounds per square inch gauge during this fifth phase. Deadbolt knob operator 38 remains unoperated during the closing of door 10. It may be seen, then, that piston rod 70 "dwells" during the closing of door 10. This dwell interval is brought about by the arrangement of springs 82, 84 shown in FIG. 3.

That is to say, the combined force of springs 82 and 84 during the earlier part of the inward stoke of piston rod 70 is sufficient to overcome the existing air pressure in pneumatic cylinder 66 and supply tube 62, and thus to rapidly move piston rod 70 downwardly sufficiently to release doorknob 26 and permit main latch 22 to completely project from the outer edge of door 10, thus accomplishing a guard against the door bouncing out of alignment during phase 6 and guaranteeing proper alignment for deadbolt 24 in doorjamb.

When, however, spring 84 is fully extended, the only downward pressure on piston 72 (FIG. 3) is that of a much lighter spring 82, which is insufficient to further drive piston 72 and piston rod 70 downwardly until the pressure in cylinder 66 and supply tube 62 drops to a much lower level, e.g., about ten pounds per square inch gauge.

Thus, the dwell action produced by the combination of springs 82, 84 shown in FIG. 3, acting against the air pressure in cylinder 66, results in a time delay between the release of doorknob 26 and the rotation of deadbolt knob 28, thus accomplishing a guard against the door bouncing out of alignment during phase 6 and guaranteeing proper alignment for deadbolt 24 in doorjamb, during which dwell interval (FIG. 2F) door 10 is swung from its fully open position to its fully closed position by door swinging system 32.

In said actual operating embodiment of my present invention the time duration of the closure of door 10 is between six seconds and fifteen seconds, which duration is adjustable by means of valves 132 and 144.

Figure 2G:
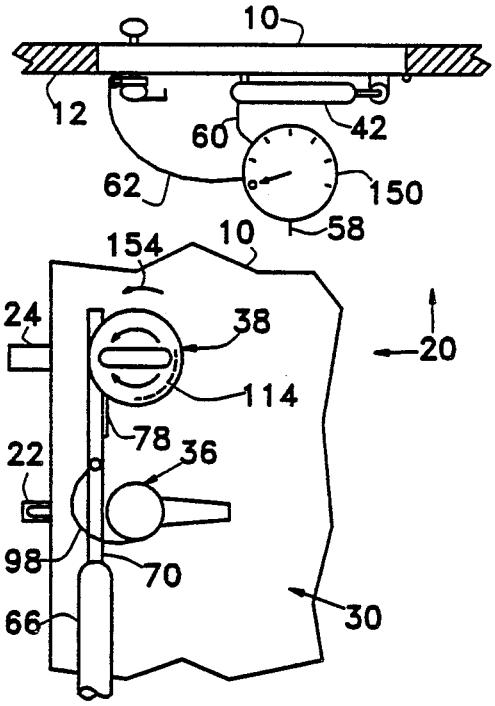

Referring now to FIG. 2G, there is shown the last or sixth phase of the complete operating cycle of automatic operating system 20. More particularly, FIG. 2G represents the completion of the sixth phase.

As may be seen by comparing FIGS. 2F and 2G, the air pressure in air supply tubes 58, 60, 62 drops from about ten pounds per square inch gauge to less than five pounds per square inch gauge during this sixth phase of the complete operating cycle of automatic operating system 20.

As will be apparent to those having ordinary skill in the art, informed by the present disclosure, the system air pressure over this range is insufficient to oppose the operation of elongated return spring 82 (FIG. 3), and thus piston rod 70 is drawn further into cylinder 66 under the resilient urging of spring 82 as the system pressure decreases over this range.

As the system air pressure decreases over this range and piston rod 70 retreats (downward) into cylinder 66 the hook-and-loop fastening material 78 on piston rod 77 engages the pileate fastening material applied to the outer surface of clamping band 114, thus coupling deadbolt knob operator 38 to piston rod 78.

The further retreating (downward) movement of piston 70 thus coupled to deadbolt knob operator 38 causes deadbolt knob operator 38 to rotate in a counterclockwise direction, as indicated by arrow 154, until it reaches the position shown in FIG. 2G, in which deadbolt 24 is fully extended into its associated recess in doorframe 12.

As best seen in FIG. 3, hook-and-loop fastening material facing 78 does not extend to the outer end of piston rod 70. Rather, there is provided a "dead zone" between the outer end of hook-and-loop fastening material facing 78 and the outer end of piston rod 70. This dead zone is of such length that the outer end of hook-and-loop fastening material facing 78 disengages from the hook-and-loop fastening material on clamping band 114 when deadbolt knob operator 38 reaches its "knob horizontal" position in which deadbolt 24 is fully extended. After this disengagement of hook-and-loop fastening material facing 78 from the hook-and-loop fastening facing on clamping band 114 piston rod 70 is further retracted by the action of spring 82 until hook-and-loop fastening material facing 78 reaches the position shown in FIG. 3, in which there is no coupling between piston rod 70 and deadbolt knob operator 38. By this feature of my invention deadbolt knob operator 38 can then by manually operated without the application of more force than is necessary to operate deadbolt knob 28 alone.

In said actual operating embodiment of my invention the duration of phase six is approximately three to six seconds.

Figure 2H:
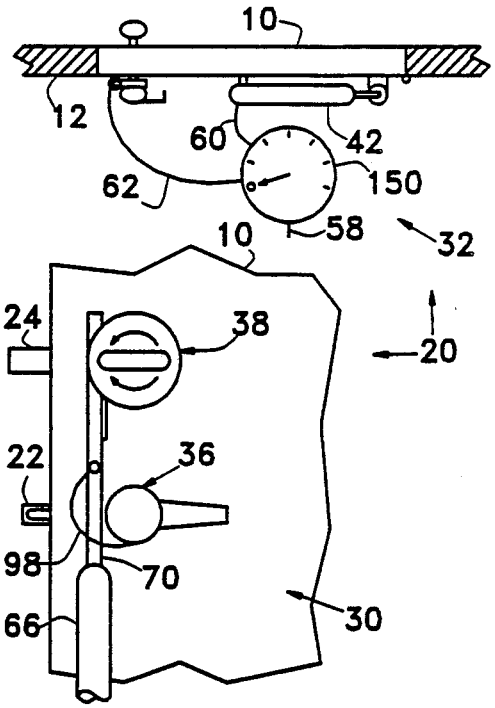

Referring now to FIG. 2H, it will be seen that automatic swinging door operating system 20 of the first preferred embodiment of my invention has returned to its normal, quiescent state, in which the system air pressure, as indicated by gauge 150, has returned to atmospheric level, by bleeding through valve 132 and check valve 133 (FIG. 1) and valve 144 (FIG. 8).

In this condition automatic swinging door operating system 20 of the preferred embodiment of my invention is completely reset, and thus is again ready to execute a complete operating cycle as shown in FIGS. 2A through 2H and described hereinabove in connection with those figures, upon the triggering of transmitter 56 by the depression of the pushbutton located thereon.

It will now be understood by those having ordinary skill in the art, informed by the present disclosure, that when door 10 and automatic operating system 20 reach the respective states indicated in FIG. 2D they will remain in these states until the pushbutton on transmitter 56 is again depressed, whereupon the closing and latching operations of the fourth through sixth phase (FIGS. 2E through 2H) will automatically be carried out without further intervention by the user.

It will thus be seen that the objects set forth above, among those made apparent from the preceding description, are efficiently attained, and since certain changes may be made in the above constructions without departing from the scope of my invention it is intended that all matter contained in the above description or shown in the accompanying drawings shall be interpreted as illustrative only, and not in a limiting sense.

It is also to be understood that the following claims are intended to cover all the generic and specific features of my invention hereindescribed, and all statements of the scope of my invention which, as a matter of language, might be said to fall therebetween.

What is claimed is:

1. An automatic operating system for a swinging door having latching means including knob means, comprising:

knob operating means attachable to said knob means without modification thereof for manual and motive power operation thereof; and motive power means for operating said knob operating means;

said knob operating means and said motive power means being entirely external to the structure of said door.

2. An automatic operating system for a swinging door as claimed in claim 1 in which said motive power means includes a translatable member faced with hook-and-loop fastening material which is juxtaposed to hook-and-loop fastening material on said knob operating means.

3. An automatic operating system for a swinging door as claimed in claim 1 in which said knob operating means is uncoupled from said motive power means when said operating system is in its quiescent state.

4. An automatic operating system for a swinging door as claimed in claim 1, further comprising pressurized working fluid supply means for supplying pressurized working fluid to said motive power means and remote control means for starting and stopping the operation of said working fluid supply means.

5. An automatic operating system for a swinging door as claimed in claim 4 in which the energization of said working fluid supply means by the manual operation of said remote control means automatically results in the operation of said knob operating means, and the subsequent de-energization of said working fluid supply means by the operation of said remote control means automatically results in the restoration of said knob operating means to the unoperated state thereof.

6. An automatic operating system for a swinging door having latching means including knob means, comprising:

knob operating means attachable to said knob means without modification thereof for manual and motive power operation thereof; and motive power means for operating said knob operating means;

said knob operating means and said motive power means being entirely external to the structure of said door but for fastening means which fasten said knob operating means and said motive power means to said door.

7. An automatic operating system for a swinging door having latching means including knob means, comprising:

knob operating means attachable to said knob means without modification thereof for manual and motive power operation thereof;

motive power means for operating said knob operating means;

door opening and closing means;

power supply means for supplying power to said motive power means and said door opening and closing means; and portable remote control means for controlling said power supply means from either side of said door;

said system being entirely external to the structure of said door but for fastening means which fasten said knob operating means, said motive power means, and said door opening and closing means to said door, and said remote control means being unattached to any part of said door.

8. An automatic operating system for a swinging door as claimed in claim 7 in which said power supply means is a source of working fluid.

* * * * *